US011988444B2

(12) United States Patent
Bihr et al.

(10) Patent No.: US 11,988,444 B2
(45) Date of Patent: May 21, 2024

(54) DOMESTIC APPLIANCE HAVING A CAMERA ARRANGED IN A DOOR

(71) Applicant: BSH Hausgeraete GmbH, Munich (DE)

(72) Inventors: Daniel Bihr, Kirchheim am Ries (DE); Hans Peter Werner, Giengen (DE); Christopher Rodney, Burgau (DE); Stephan Kempfle, Ellzee (DE)

(73) Assignee: BSH Hausgeraete GmbH, Munich (DE)

( * ) Notice: Subject to any disclaimer, the term of this patent is extended or adjusted under 35 U.S.C. 154(b) by 361 days.

(21) Appl. No.: 17/438,492

(22) PCT Filed: Mar. 30, 2020

(86) PCT No.: PCT/EP2020/058923
§ 371 (c)(1),
(2) Date: Sep. 13, 2021

(87) PCT Pub. No.: WO2020/201199
PCT Pub. Date: Oct. 8, 2020

(65) Prior Publication Data

US 2022/0412645 A1 Dec. 29, 2022

(30) Foreign Application Priority Data

Apr. 1, 2019 (DE) ..... 10 2019 204 534.0

(51) Int. Cl.
*F25D 29/00* (2006.01)

(52) U.S. Cl.
CPC ..... *F25D 29/005* (2013.01); *F25D 2700/02* (2013.01)

(58) Field of Classification Search
CPC ..... F25D 29/005; F25D 2700/02
See application file for complete search history.

(56) References Cited

U.S. PATENT DOCUMENTS 9,528,756 B2 * 12/2016 Kim ..... F25D 23/067
11,501,250 B2 * 11/2022 Han ..... G06Q 10/087
(Continued)

FOREIGN PATENT DOCUMENTS

DE 102013216759 A1 2/2015
DE 102017213425 A1 2/2019
(Continued)

*Primary Examiner* — Ljiljana V. Ciric
(74) *Attorney, Agent, or Firm* — Laurence A. Greenberg; Werner H. Stemer; Ralph E. Locher

(57) ABSTRACT

A domestic appliance, which may be a cooling device, such as a refrigerator, includes: a treatment chamber that can be closed by a pivotable door; at least one camera arranged in the door for recording images from the treatment chamber when the door is open; and a door movement sensor for detecting values of at least one parameter of a door movement. The door movement sensor has at least one inertial sensor. At least one camera and the at least one inertial sensor are integrated in a camera/sensor module which is arranged in the door. The camera/sensor module has a communication device, at least for outputting image data from the camera of the camera/sensor module. The domestic appliance is configured to trigger at least one device function upon the detection of at least one trigger value.

17 Claims, 2 Drawing Sheets

(56) References Cited

U.S. PATENT DOCUMENTS

| | | | | |
|---|---|---|---|---|
| 11,512,890 | B2 * | 11/2022 | Bechtle | G03B 15/00 |
| 11,821,677 | B2 * | 11/2023 | Grimminger | H04N 7/188 |
| 2014/0293060 | A1 * | 10/2014 | Ryu | F25D 29/00 348/159 |
| 2014/0313331 | A1 * | 10/2014 | Kim | F25D 29/00 348/143 |
| 2016/0138860 | A1 * | 5/2016 | Kang | F25D 29/00 62/130 |
| 2016/0182764 | A1 * | 6/2016 | Akasaka | B41J 2/2054 358/1.9 |
| 2016/0182768 | A1 * | 6/2016 | Martens | A63B 21/4039 348/231.5 |
| 2020/0158417 | A1 * | 5/2020 | Bechtle | G03B 15/00 |
| 2021/0164721 | A1 * | 6/2021 | Grimminger | G01P 15/00 |
| 2022/0412645 | A1 * | 12/2022 | Bihr | F25D 29/005 |
| 2023/0043011 | A1 * | 2/2023 | Kim | F25D 29/00 |
| 2023/0194148 | A1 * | 6/2023 | Kempfle | H04N 23/90 62/449 |
| 2023/0194149 | A1 * | 6/2023 | Kempfle | F25D 29/005 62/449 |
| 2023/0194158 | A1 * | 6/2023 | Kempfle | F25D 29/005 62/125 |

FOREIGN PATENT DOCUMENTS

| | | | | |
|---|---|---|---|---|
| EP | 3662218 | B1 * | 12/2021 | F25D 23/028 |
| WO | 2018142136 | A1 | 8/2018 | |
| WO | 2019110305 | A1 | 6/2019 | |

* cited by examiner

DOMESTIC APPLIANCE HAVING A CAMERA ARRANGED IN A DOOR

BACKGROUND OF THE INVENTION

Field of the Invention

The invention relates to a household appliance, having a treatment chamber which can be closed by means of a pivotable door, at least one camera arranged in the door for recording images from the treatment chamber when the door is opened and a door movement sensor for detecting values of at least one parameter of a door movement, wherein the household appliance is designed to trigger at least one appliance function when at least one trigger value is detected. The invention can be applied particularly advantageously to refrigeration appliances, in particular refrigerators.

At present a door movement is detected by Hall sensors and magnets, of which one component is located on the door and the other component is located on a stationary part of the household appliance (also referred to below as "carcass"). It is therefore possible to detect that a fixedly predetermined door opening angle (also referred to as "trigger angle") has been reached or overrun, this being determined by the fixed installation position of the two components relative to one another. Defining a new trigger angle is disadvantageously only possible by manual readjustment of the position of the components on the appliance. The practically non-existent possibility of easily readjusting the position of the Hall sensor and/or magnet is then particularly disadvantageous if over time changes to the position of the door on the household appliance occur, e.g. a door lowering.

Variations from the target trigger angle are disadvantageous for instance in the event that there is a camera installed in a door of a refrigerator, which when the door is opened, namely when the trigger angle is reached in the case of an opening movement, begins to record images of a refrigeration chamber which can be closed by the door. If the trigger angle is misaligned, the camera triggers at the wrong point in time so that an evaluability of the images thus recorded is reduced.

US 2014/0293060 A1 discloses a refrigerator. The refrigerator has a main body or carcass with a storage compartment, a first door, which is installed rotatably on a first side of the main body, in order to open and close a first section of the storage space, and a second door, which is installed rotatably on a second side of the main body, in order to open and close a second section of the storage compartment. A first camera can be installed on the first door, in order to record an image of an interior of the storage compartment during the rotation of the first door, and a second camera can be installed on the second door, in order to record an image of the interior of the storage compartment during rotation of the second door. A controller can combine a number of images recorded by the first camera and by the second camera to form a single, corrected image of a region of the storage compartment, which extends from the first door to the second door.

US 2014/0313331 A1 discloses a refrigerator and an operating method. The operating method of the refrigerator, which can contain a drawer and a camera, can comprise the recognition of the beginning of a closing process of the drawer, the acquisition of an internal image of the drawer using the camera at a point in time at which the closing process of the drawer is initiated, and an external display and/or transmission of the final image.

US 2016/0182764 A1 discloses a camera system with a camera facility, which is used as an image acquisition unit, a communication unit, which is configured to transmit image information acquired by the camera facility to an external appliance; and a display, which is configured to display image information which is acquired by the camera device, wherein the display is configured so that it indicates at least one of the items of image information which have been acquired by the camera device according to prescribed conditions and image information which has been acquired according to user instructions.

US 2016/0182768 A1 discloses a camera apparatus for use in a storage facility. The camera apparatus is provided with a housing, which is configured so that it can be installed in a storage facility, with an image recording element, which is provided within the housing, and with an image recording window, which is provided on a first surface section of the housing and is designed to acquire an image within the storage facility by means of the image acquisition element. The image recording element is configured so that an image is recorded in the storage facility in which the housing is installed.

SUMMARY OF THE INVENTION

It is the object of the present invention to overcome the disadvantages of the prior art at least partially and in particular to provide an easily implementable possibility for improving the recognition of a door movement, particularly of a refrigerator, in the door of which a camera for recording images from a refrigeration chamber is installed.

This object is achieved according to the features of the independent claims. Advantageous embodiments form the subject matter of the dependent claims, the description and the drawings.

The object is achieved by a household appliance, having

- a treatment chamber which can be closed by means of a pivotable door,
- at least one camera arranged in the door for recording images from the treatment chamber, in particular when the door is opened,
- a sensor (door movement sensor) for detecting values (parameter values) of at least one parameter of a door movement (door movement parameter) and wherein

- the door movement sensor has at least one inertial sensor,
- at least one camera and the at least one inertial sensor are integrated in a module (referred to below without restricting the generality as "camera/sensor module"), which is arranged in the door,
- the camera/sensor module has a data communication facility at least for emitting image data of the camera of the camera/sensor module and
- the household appliance is designed to trigger at least one appliance function by detecting at least one predetermined parameter value (referred to below without restricting the generality also as "trigger value" or "target value").

In one embodiment, the at least one door movement parameter comprises a door opening angle, a door movement direction (e.g. a door opening or door closure) and/or a door speed (e.g. an angular speed when the door is pivoted).

This household appliance has the advantage that the at least one door movement parameter can be determined continuously or virtually continuously over the entire door movement and it is not only a single trigger angle which is detected as with Hall sensors, for instance. As a result, there is in turn the possibility of appliance functions being controllable as a function of a number of trigger values, e.g. as a function of different door opening angles achieved.

There is also the further advantage that the at least one trigger value can be adjusted arbitrarily, without having to perform mechanical changes to the appliance. This can be used advantageously, for instance, to compensate for signs of use and/or assembly tolerances. The use of different cameras, which, on account of different fields of view, require different trigger values for triggering purposes, can also be carried out easily in series or when exchanged by customer services by adjusting the trigger value etc.

By arranging the at least one camera and the at least one inertial sensor in a shared structural unit or module, the advantage of a reduced assembly outlay is achieved in terms of manufacture. Moreover, a number of lines in the appliance and in particular in relation to the appliance door can be significantly reduced. The possibility of a system failure as a result of incorrect assembly or damaged electrical lines is also reduced. Furthermore, a particularly compact design is enabled.

An inertial sensor can in particular be understood to mean a sensor which is designed to independently measure translational and/or rotational accelerations. In one development, the camera/sensor module has one or more inertial sensors, in particular of a different type and/or alignment. For instance, a rotation rate sensor, an acceleration sensor or a combination thereof can be installed in the camera/sensor module, for instance. Measured value resolution of +/−1° can be achieved with an inertial sensor with a maximum opening speed of 90°/s or even more.

In one development, at least one inertial sensor is a rotation rate sensor. This is particularly suited to determining a current opening angle of the door with high precision and reduced outlay. In particular, the angular speed of the door can be measured by means of the rotation rate sensor, and therefrom, for instance by integration of the measured angular speed over time, the door opening angle can be determined.

In one development, a door opening angle of zero (which corresponds to a closed door) can be determined by switching a door switch.

In one development, the rotation rate sensor is a vibrating structure gyroscope (VSG). This is particularly robust, small and cost-effective.

In one development, at least one inertial sensor is an acceleration sensor. The acceleration sensor is provided in particular to measure linear accelerations.

Basically a door opening angle can also be determined with an acceleration sensor, particularly if the door is only opened a little. However, a determination accuracy with larger door opening angles is reduced considerably for a single acceleration sensor. This can be balanced out by using a number of acceleration sensors aligned differently.

Another advantageous application of an acceleration sensor consists in determining a drift of a rotation rate sensor. By taking the thus determined drift into account, a door movement parameter, in particular door opening angle, determined by the rotation rate sensor can be corrected and thus determined more accurately. In particular for this application, but essentially also for other applications, it is advantageous for at least one rotation rate sensor and at least one (linear) acceleration sensor to be installed in at least one camera/sensor module.

In one development, at least one inertial sensor is an MEMS sensor. An MEMS (Micro-Electro-Mechanical System) sensor has the advantage that it can be realized directly in integrated switching circuits.

Alternatively to an MEMS sensor, at least one inertial sensor can be a piezoelectric sensor. This can have quartz rods, for instance, which are slightly arched when accelerated and marginally detune an electrical oscillating circuit.

In one development which is advantageous to reducing a computing outlay, one or more axes of at least one inertial sensor are excluded from the evaluation. If an inertial sensor measures an acceleration in all three cartesian spatial axes, for instance, only the spatial axes which are at right angles to an axis of rotation of the door are to be evaluated, since along its axis of rotation the door does not carry out any movement or any practically usable movement.

The camera can be embodied as a module ("camera module"), which can have e.g. an in particular semiconductor-based image recording system (for instance a CCD chip), camera electronics for operating the image recording sensor, optics arranged upstream of the image recording sensor etc. The camera can be a black/white camera or advantageously a color camera.

In one development, the camera/sensor module is connected, for its operation, to an energy storage device which can be charged wirelessly at least when the door is closed. This is advantageous in that it is possible to dispense with a power supply line to the inertial sensor. The energy storage device can have at least one super capacitor, for instance. The energy storage device can be used to supply electrically operated components of the camera/sensor module, such as the camera, of the least one inertial sensor etc. with energy. The fact that the energy storage device can be charged wirelessly at least when the door is closed can mean that the energy supply is no longer effective when the door is noticeably opened. In one development, the energy storage device can be charged inductively. To this end, it can be connected to a pick-up, in which an induction voltage can be induced by means of an inductive alternating field, in order to charge the energy storage unit and possibly to operate further components of the camera/sensor module. To implement this development, at least one primary coil arranged and designed to generate the inductive (charging) alternating field can be present in the carcass of the household appliance. For effective energy transmission, the primary coil faces the pick-up when the door is closed.

In another development, the camera/sensor module can be supplied with energy in a grid-bound manner. This is advantageous in that it is possible to dispense with an energy storage device. To this end, a power supply line can be guided out of the carcass into the door, e.g. a simple two-wired line.

The camera/sensor module can basically be charged wirelessly and at least one other camera located in the door can be supplied with energy in a grid-bound manner.

In one embodiment, the camera/sensor module is designed to trigger at least one appliance function ("camera function") or action assigned to the camera of the camera/sensor module (camera inside the module) by detecting at least one trigger value by means of the at least one inertial sensor. This achieves the advantage that the camera/sensor module can autonomously control its at least one camera, which in turn enables a particularly simple data architecture of the household appliance. The at least one camera function can comprise waking or bringing the camera out of a switched-off state into an operationally ready standby state, triggering the camera to record an image, switching off the camera etc.

In one development, the data communication facility has or is a wireless or wired data interface for wireless or wired communication with at least one other component of the household appliance, e.g. with a central control facility, at least one further camera, a monitor etc. A wireless data interface is advantageous in that no data transmission line is required to be fed into the door or doors to the module.

In one development, the data communication facility of the camera/sensor module has or is a bidirectional data interface and can thereby emit and receive data, e.g. now also calibration data, control commands, such as for waking a camera from a switched-off state into a standby state, for triggering the camera, for heating a housing window etc. This enables a particularly flexible use and adjustment of the module, particularly also in normal operation with a user. The data communication facility can then also be referred to as a transceiver. Space is also saved as a result of the bidirectional data interface compared with an essentially likewise possible provision of a unidirectional interface for receiving and a unidirectional interface for transmitting data.

If the data communication facility has a bidirectional data interface, in one development the camera/sensor module or one or more of its components can be controlled externally. The advantage is achieved of enabling a particularly ii flexible use of the camera/sensor module. For instance, at least one camera of the camera/sensor module can be woken, triggered, switched off etc. by way of a command received by way of the bidirectional data interface. If the camera/sensor module has a number of cameras, a specific camera for image recording can be triggered by a received command in particular, or a number of, in particular all of the cameras can be triggered. It is also possible to calibrate and reconfigure the evaluation facility externally, e.g. in order to change, add or delete trigger values, etc.

In one development, in particular with the embodiment of the data interface as a unidirectional interface or transmitter, the data communication facility can only be connected to the camera. In another development, in particular with the embodiment of the data interface as a bidirectional interface or transceiver, the data communication facility can be connected to the camera and the at least one inertial sensor.

In one embodiment, the household appliance has at least one further camera (outside the module) associated with the camera/sensor module and is designed to trigger at least one appliance function or camera function assigned to the camera outside the module using the at least one inertial sensor of the camera/sensor module. The advantage is achieved in that the at least one inertial senor of the camera/sensor module can also be used to release or trigger cameras outside the module, which can be arranged at basically any other points in the household appliance (for instance not in the door, but instead in the area of a wall of the treatment chamber). The camera/sensor module can be connected directly or indirectly for data purposes to the at least one camera, outside the module, by way of a control facility, for instance.

In one development, a number of cameras which are inside and/or outside the module can be triggered independently of one another on the basis of a respective door opening angle. This is advantageous in that images can be recorded from a particularly advantageous direction or perspective. The cameras can trigger with the same and/or different door opening angles.

In one embodiment, the household appliance is designed to trigger at least one further appliance function, which is not a camera function, when at least one trigger value is detected by means of the at least one inertial sensor of the camera/sensor module. This is advantageous in that a user friendliness and/or functional improvement can be achieved. The further appliance function can also be referred to as a "non-camera appliance function".

In one development, the at least one further appliance function comprises a light controller of the household appliance. A light generation can therefore advantageously be adjusted particularly in various ways to the current door opening angle. The light controller can comprise a change in brightness and/or a change in color of the light generated by the household appliance. To this end, the household appliance can have a least one light-generating facility, which can be actuated directly by the camera/sensor module or by way of the control facility, for instance. The light-generating facility can have e.g. one or more LEDs.

In one development, the light controller comprises a light controller of a light radiated into the treatment chamber by at least one light-generating facility. For instance, the treatment chamber can be illuminated more brightly, the smaller the door opening angle. This is advantageous in order to standardize an overall brightness in the treatment chamber, possibly by taking into account incident ambient light. With refrigeration appliances a treatment chamber can be understood to mean for instance a refrigeration chamber of a refrigerator, with cooking appliances a cooking chamber, with dishwashers a dishwasher chamber etc.

The at least one further appliance function can comprise in particular a brief increase in an illumination strength which is dependent upon the door opening angle in the treatment chamber at the point in time of the at least one camera triggering. This can advantageously achieve an improved recording brightness. In one development, this can comprise an emission of one or more flashes into the treatment chamber in synchrony with a trigger time instant of a camera. In particular, the illumination strength can be targetedly increased briefly with a number of door opening angles.

In one development, the light controller comprises a light controller of a light emitted by the household appliance into the surroundings. Therefore a color of light, which is emitted by the control elements and/or decoration elements, can be changed as a function of the door opening angle. This can be advantageous, for instance, in order to communicate the door opening state to a user in a more effective manner.

As a further appliance function, voice control can also be particularly advantageously implemented by means of the at least one inertial sensor. For instance, a voice controller can be activated or deactivated as a function of an opening angle of the door.

In one embodiment, the camera/sensor module has a housing, in which the at least one camera and on or in which the at least one inertial sensor are arranged. This yields the advantage of a particularly simple operation and a robust design. Moreover, the components of the module accommodated in the housing are particularly protected against external influences such as dirt, dust and/or humidity. The housing can therefore be in particular a dust- and/or humidity-proof housing.

In one embodiment, the housing has a transparent window (see-through window) arranged in the field of view of the camera. This makes it possible to protect the camera with a simultaneously unimpaired use of the camera. The window can be present in the form of a housing opening, for instance, which is covered by a transparent panel, for instance glass panel or plastic panel. The use of a glass panel is especially advantageous in that the window is high-grade tough, optically transparent, and resistant to discoloration.

In one embodiment, the transparent window or its panel can be heated, for instance by means of a window heater, in particular of the module. The window heater can have one or more thin wires or electrically conducting transparent conductor paths (for instance made from ITO), which are used as electrical resistance heating lines. The use of a window heater has in particular the advantage, in cooling appliances, that the window does not mist up when the door is opened. In one development, the window heater can be activated and deactivated as a function of a trigger value detected by the at least one inertial sensor, in particular a specific door opening angle. The advantage is achieved in that the window heater is only heated in practically relevant movement states of the door, as a result of which electricity costs are spared. For instance, the window heater can be activated if a reaching of a first door opening angle when the door is opened is established by means of the at least one inertial sensor, and deactivated if a reaching of a second, larger door opening angle is established when the door is opened. In one development, the window heater cannot be activated when the door is closed.

Alternatively, the housing of the camera/sensor module can also have an uncovered housing opening, which is arranged in the door behind a transparent window of the door inner wall. The transparent window of the door inner wall or its panel can also be heated.

In one embodiment, the housing and/or a door wall has a transparent, heatable window arranged in the field of view of the camera, the panel of which can be heated depending on at least one trigger value of at least one door movement parameter, detected by the module or its at least one inertial sensor, being reached.

In one embodiment, the camera/sensor module has an evaluation facility, which is designed, in particular programmed, to evaluate measuring signals of the at least one inertial sensor in order to determine the at least one parameter value, to compare the same with one or more trigger values or target values and to trigger at least one action by detecting at least one trigger value. The advantage is therefore achieved that the camera/sensor module has a higher "intelligence" and as a result can also autonomously execute more complex control processes. The at least one action can comprise for instance a triggering of the at least one camera of the module, a triggering of at least one further camera of the household appliance etc. To this end, the evaluation facility can have at least one processor unit such as a microprocessor, an FPGA, an ASIC etc. However, it is also possible to perform the control of the camera/sensor module at least partially by means of the control facility of the household appliance. The camera/sensor module can be configured particularly easily in this way.

In one development, the evaluation facility is designed to be configured by way of the data interface. The advantage is achieved in that a flexible adjustment of the camera/sensor module is enabled, for instance in order to reset trigger values such as predetermined door opening angles (trigger angles). Trigger values can be changed, added and/or deleted, for instance. In one development, the evaluation facility to this end has a data storage unit, in particular a programmable non-volatile data storage device such as an EEPROM or the like.

The evaluation facility can be merged with the at least one inertial sensor in a shared "integrated sensor". The evaluation unit and the at least one inertial sensor can also be arranged on a shared module, e.g. on a shared printed circuit board. If the evaluation unit with the inertial sensor is merged in an integrated sensor, the evaluation unit can, similarly to the inertial sensor, be connected to the energy storage device or can be supplied with energy in a wired manner.

In one embodiment, the data communication facility, possibly together with the evaluation facility, is embodied on a printed circuit board ("communications printed circuit board"), and the at least one inertial sensor is likewise arranged at or on the communications printed circuit board. A particularly compact and robust arrangement is therefore provided. In one embodiment, the camera/sensor module has a housing, in particular as described above. The housing has an insertion opening for inserting the camera, and the insertion opening is closed or covered by the communications printed circuit board. The communications printed circuit board can therefore be used as a cover of the housing and in the process be arranged in or on the housing, in particular inserted into the housing.

Generally the at least one camera, the at least one inertial sensor, the data communication facility, the evaluation facility and/or further components such as a light source for illuminating a field of view of the camera etc. can be accommodated in the housing.

In one embodiment, each camera or each camera module of the household appliance has a code unique to the appliance. The advantage is achieved in that during assembly of the household appliance, an identification routine for identifying the camera (e.g. a door camera and a treatment chamber camera) can be omitted. On account of the unique assignment of the camera, this in turn produces a time saving with the final initializing of the appliance at the end of the production line. When a camera is replaced (e.g. by customer service on the user's premises), renewed initialization no longer needs to be carried out.

In one development, the code is provided by means of a hardware-side encoding of the camera or the camera module. This makes it possible to identify a camera particularly easily. The hardware-side encoding can be implemented for instance in that a number of contacts or pins of the camera are provided for encoding, e.g. by a signal level which is unique to the camera being applied to them. If three pins are provided for encoding, and each of the pins can assume either the signal level or signal states "0" or "1", for instance, eight (=3 bit decimal) codes are available overall, in order to produce a unique assignment. This information is always dispatched during communication with the camera or the associated camera/sensor module and thus facilitates the assignment.

In general, with a unidirectional or bidirectional embodiment of the data communication facility or the data interface, one or more of the following items of data can be dispatched by the camera/sensor module by way of the data interface, e.g. to a control facility, to cameras outside the module and/or to a light-generating facility:

- one or more current parameter values,
- trigger signals or control commands which are produced when a respective trigger value is reached,
- image data of the at least one camera,
- status data relating to the state of the camera/sensor module and/or specific components thereof,
- etc.

In general, with a bidirectional embodiment of the data communication facility or the data interface, one or more of the following items of data can be received by the camera/sensor module by way of a data interface, for instance:

- trigger signals or control commands for triggering the at least one camera of the camera/sensor module, control commands for bringing the at least one camera out from a switched-off state into a standby state, and vice versa, control commands for activating and deactivating a light source of the camera/sensor module (camera light), if available, control commands for activating and deactivating a window heater;

trigger values and/or associated actions;

etc.

At least some of this data, in particular all of this data, can also be generated by the camera/sensor module itself, in particular its evaluation facility.

By using the at least one inertial sensor of the camera/sensor module, trigger values can be provided for instance to trigger one or more of the following actions:

bringing the camera into a standby state switching off the camera, triggering at least one camera of the module, possibly with different trigger values, including the possibility of repeatedly triggering a camera with multiple trigger angles (e.g. in order to generate a series of images);

activating and deactivating the camera light, if present;

activating and deactivating a window heater;

outputting control commands (standby, switching off, triggering, camera light etc.) to cameras of the household appliance which are outside the module;

etc.

In one development, the camera located in the standby state can also be triggered by means of a corresponding control command.

In one embodiment, the household appliance is a refrigeration appliance and the treatment chamber is a refrigeration chamber. The refrigeration appliance can be in particular a refrigerator, e.g. an independent refrigerator, a fridge/freezer combination etc. Particularly with a refrigerator, a camera for recording images of the refrigeration chamber can also be referred to as a "Camera in Fridge" CiF.

However, the household appliance can basically also be any other, in particular electrically operated household appliance, e.g. a large household appliance or a small household appliance, in particular a kitchen appliance, particularly in the sense of white goods. The household appliance can therefore also be a cooking appliance, a laundry care appliance, a dishwasher etc.

The afore-described properties, features and advantages of this invention and the manner in which they are achieved will become clearer and more intelligible in conjunction with the following schematic description of an exemplary embodiment, which is explained in more detail below in conjunction with the drawings.

DETAILED DESCRIPTION OF THE INVENTION

Figure 1:
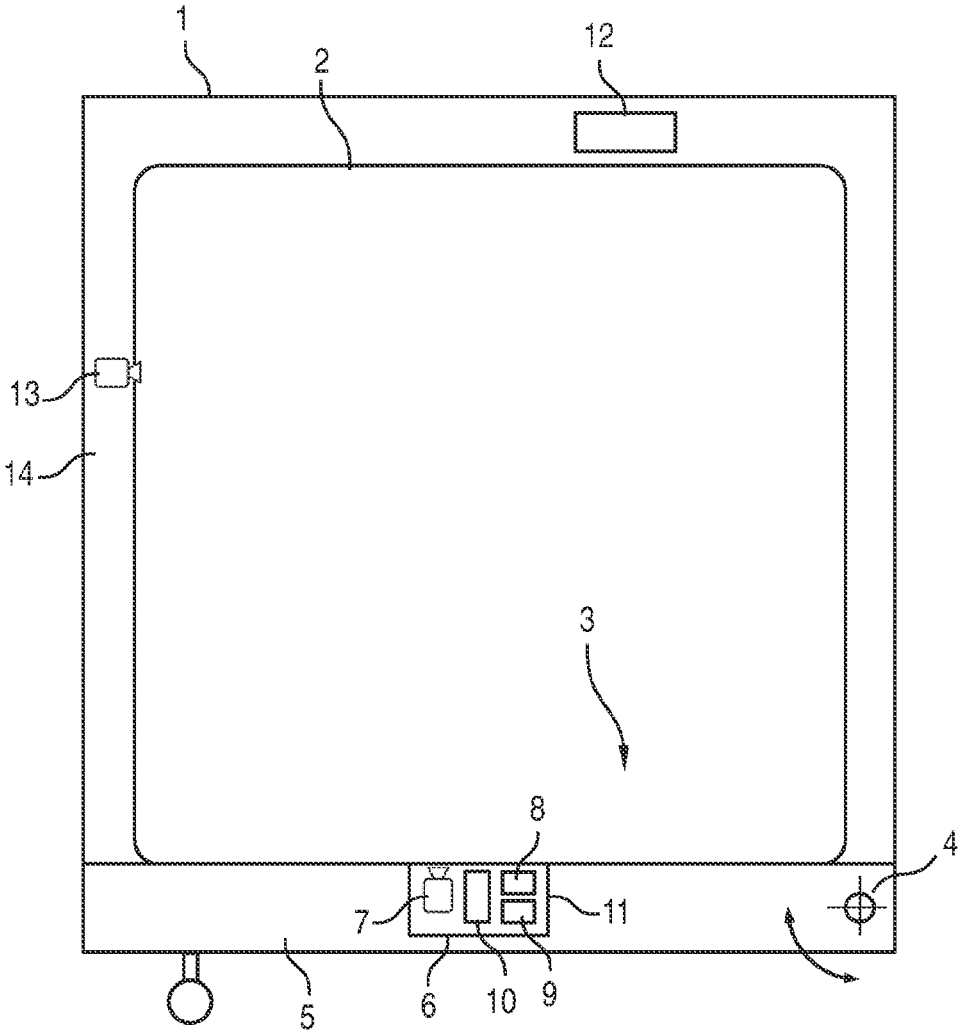
FIG. 1 shows as a sectional representation in a top view a drawing of a refrigerator with a camera/sensor module.

FIG. 1 shows as a sectional representation in the top view a drawing of a household appliance in the form of a refrigerator 1. The refrigerator 1 has a treatment chamber in the form of a refrigeration chamber 2, the front loading opening 3 of which can be closed by means of a door 5 which can be pivoted about an axis of rotation 4 aligned vertically, as also indicated by the double arrow. A camera/sensor module 6 is arranged in the door 5.

The camera/sensor module 5 has an (integral) camera 7 which is embodied here as a camera module, which is arranged so that it can record images from the refrigeration chamber 2 at least when a door is only slightly opened. The camera/sensor module 6 further has at least one door movement sensor in the form of an inertial sensor 8, an e.g. wired data communication facility 9 and an evaluation facility 10. These components 7 to 10 are accommodated or attached in a housing 11 of the camera/sensor module 6. The housing 11 can have a heatable see-through window (top fig.) for the camera 7.

The at least one inertial sensor 8 is designed (i.e. arranged and configured) to detect at least one door movement parameter of the door 5. These currently detected door movement parameters are compared with predetermined target or trigger values by means of the evaluation facility 10. If the currently detected door movement parameters reach at least one trigger value such as a specific door opening angle (possibly also a combination also of a number of trigger values such as a specific door opening angle in conjunction with establishing a door opening), the evaluation facility 10 can trigger a corresponding action, e.g. a corresponding trigger signal or item of trigger information, namely to an internal component 7 to 9 of the camera/sensor module 6 and/or by way of the data communication facility 9 to a component outside the module.

The camera/sensor module 6 is communicatively coupled to a control facility 12 of the refrigerator 1, for instance by way of a point-to-point data line or a bus system. The control facility 12 is in particular a central control facility for controlling the refrigerator 1.

The refrigerator 1 further optionally has at least one further camera 13, in other words a camera (outside the module) which does not form part of the camera/sensor module 6, which is arranged here by way of example in a carcass 14 of the refrigerator 1 (e.g. as shown on a side wall, on the cover side etc.), but can also be arranged in the door 5. The camera 13 outside the module can be communicatively coupled directly with the camera/sensor module 6, e.g. by way of a point-to-point data line or a bus system, and/or coupled with the control facility 12.

Each camera 7, 13 or the associated camera modules can have a number of contacts or pins in each case, e.g. for data transmission, power supply etc. It is particularly advantageous if a number of these pins are used as coding pins, which are assigned fixedly predetermined (possibly reconfigurable) signal states. As a result, a camera identification which is unique to the appliance can be linked with the dispatched data from the signal assignment of this coding pin.

Image data can also be dispatched by way of the data communication facility, e.g. to the control facility 12 and/or to a monitor 15, arranged on the outside, on which the images can be displayed.

The data communication facility 9 is in particular a bidirectional data communication facility 9 for emitting and receiving data, e.g. for receiving data such as control commands, calibration or configuration data from the control facility 12. To this end it has a bidirectional data interface.

In particular, when the door 5 is moved (opened and closed), the reaching of a number of trigger values can be monitored or determined by means of the evaluation facility 10, wherein one or more actions can be assigned to a trigger value.

For instance, the following actions can be triggered when the door 5 is opened, for instance in the sequence cited with an increasing door opening angle:

- bringing or "waking" the camera 7 inside the module out from a switched-off state e.g. into an operationally ready standby state;
- emitting a signal for waking the camera 13 outside the module directly to the camera 13 outside the module or the control facility 12;
- activating the heating of the see-through window;
- emitting a signal (e.g. comprising an item of information so that a specific trigger angle has been reached) to the control facility 12 for activating at least one light function;
- triggering the camera 7 inside the module to record an image;
- emitting a signal for triggering the camera 13 outside the module to record an image;
- deactivating the heating of the see-through window
- triggering the camera 7 inside the module to receive a further image;
- emitting a signal for triggering the camera 13 outside the module to record a further image;
- etc.

At least two actions can be assigned to the same trigger value or different trigger values.

When the door is closed, corresponding actions can be triggered, including triggering the cameras 7, 13, switching off the camera 7 when a closed state of the door 5 is reached etc.

It is generally also possible to control the camera/sensor module 6 independently of the at least one inertial sensor 8 externally, e.g. by means of the control facility 12, e.g. in order to move the camera 7 inside the module into the standby state and/or to trigger the evaluation facility to be calibrated or reconfigured (e.g. to change, add or delete trigger values etc.).

Figure 2:
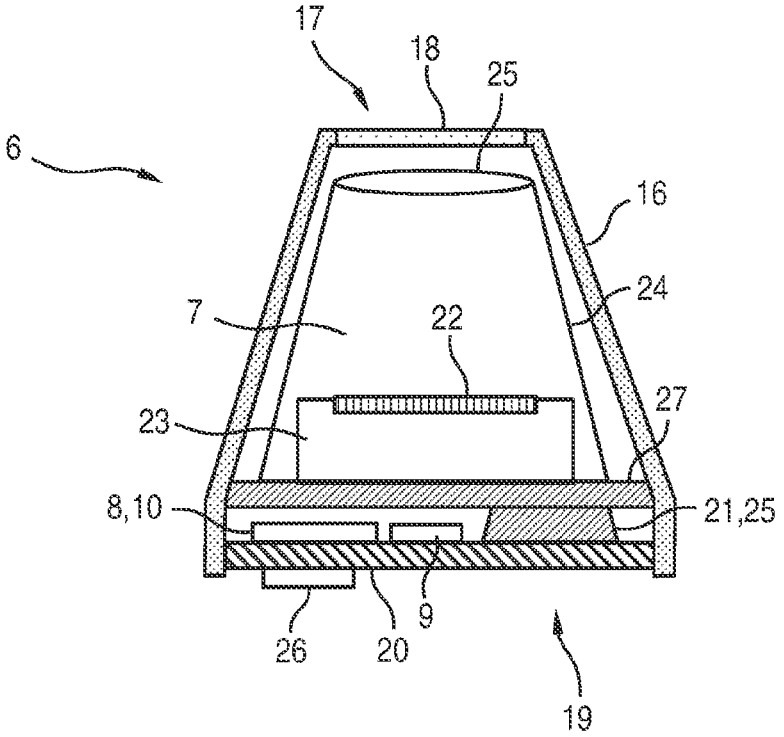
FIG. 2 shows as a sectional representation in the side view a drawing of a camera/sensor module.

FIG. 2 shows as a sectional representation in the side view a drawing of a possible implementation of the camera/sensor module 6. The camera sensor module 6 has a particularly tube-shaped housing 16, which has a housing opening 17 on the front side, which is covered by means of a particularly heatable transparent glass panel 18.

The camera 7 embodied as a camera module is accommodated in the housing 16, and has as components e.g. an image recording sensor 22 such as a CCD chip, camera electronics 23 for operating the image recording sensor 22, optics 25 arranged upstream of the image recording sensor 22 e.g. by way of a frame 24 etc.

The camera 7 can be inserted into the housing 16 through a rear-side insertion opening 19. The insertion opening 19 is closed by means of a printed circuit board (communications printed circuit board 20), which can then also be used as a cover. Here the communications printed circuit board 20 is located in the housing 16.

Figure 3:
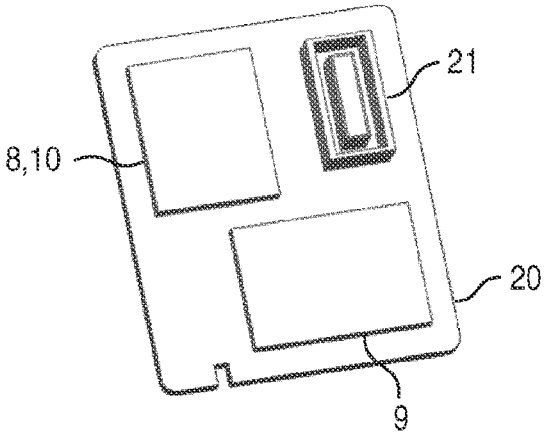
FIG. 3 shows in an oblique view a communications printed circuit board of the camera/sensor module from FIG. 2.

The communications printed circuit board 20, which is shown in an oblique view in FIG. 3, has an integrated sensor 8, 10, into which the inertial sensor 8 and the evaluation unit 10 are integrated, as well as the data communication facility 9 on a side pointing into the housing 16. On the other side facing away from the housing, the communications printed circuit board 20 can be equipped with further components such as a data interface 26 for connection with components outside the module.

On the side pointing into the housing 16, the communications printed circuit board 20 is further equipped with a plug connection element 21, which is connected to a suitable plug connection counter element 25 of the camera 7 by inserting the communications printed circuit board 20 into the housing 16. The plug connection counter element 25 of the camera 7 can have a number of contacts or pins, which are assigned fixedly predetermined signal levels in order to encode the camera 7. The camera 7 therefore has a hardware side code or encoding which is unique to the appliance.

In one possible variant, the plug connection element 21 and the plug connection counter element 25 are connected with one another by means of a simple insertion movement in relation to a plug connection 21, 25 when the communications printed circuit board 20 is inserted into the housing 16. In one variant, the plug connection 21, 25 is also used as a spacer between the communications printed circuit board 20 and the camera, in particular a base carrier 27 of the camera 7. In one variant, the camera 7 can be held in the housing 16 by means of the communications printed circuit board 20. In general, the camera 7, in particular its base carrier 27, and/or the communications printed circuit board 20 can be held in the housing 16 by means of a positive fit, form fit (e.g. locking) and/or material bonding (e.g. adhesive bonding). Alternatively or in addition, dedicated fastening means (top fig.), such as screws, clamps, pins etc. can be used to hold the camera 7, in particular its base carrier 27, and/or the communications printed circuit board 20 in or on the housing 16. The camera 7, in particular its base carrier 27, and/or the communications printed circuit board 20, can also be placed in a respective projection of the housing 16 which is molded around the inside thereof.

The present invention is naturally not restricted to the exemplary embodiment shown.

The communications printed circuit board 20 can therefore also be placed on a rear edge of the housing 16 and as a result likewise forms a cover for the housing 16.

In general, "one" etc. can be understood to mean a single or multiple, in particular in the context of "at least one" or "one or more" etc. provided this is not explicitly excluded, e.g. by the expression "precisely one" etc.

A figure can also comprise precisely the specific number and also a typical tolerance range, provided this is not explicitly excluded.

LIST OF REFERENCE CHARACTERS

1 Refrigerator
2 Refrigeration chamber
3 Loading opening
4 Axis of rotation
5 Door
6 Camera/sensor module
7 Camera
8 Inertial sensor
9 Data communication device
10 Evaluation facility
11 Housing
12 Control facility
13 Camera (outside the module)
14 Carcass
15 Monitor
16 Housing
17 Housing opening
18 Glass panel
19 Insertion opening
20 Communications printed circuit board

21 Plug connection element
22 Image recording sensor
23 Camera electronics
24 Frame
25 Optics
26 Data interface
27 Base carrier

The invention claimed is:

1. A household appliance, comprising:

a treatment chamber and a pivotable door for selectively closing said treatment chamber;

at least one camera for recording images from the treatment chamber when the door is open;

a door movement sensor for detecting values of at least one door movement parameter of a door movement of said door;

said door movement sensor having at least one inertial sensor;

said at least one camera and said at least one inertial sensor being integrated in a camera/sensor module;

said camera/sensor module being arranged in said door and having a data communication facility for emitting image data of said at least one camera of said camera/sensor module;

said camera/sensor module having an evaluation facility configured to evaluate measuring signals of said at least one inertial sensor for determining the at least one parameter value, and to trigger at least one action by detecting at least one trigger value;

said evaluation facility being combined with said at least one inertial sensor in a common integrated sensor that is disposed together with said data communication facility on a communications printed circuit board; and the household appliance being configured to trigger at least one appliance function upon detecting the at least one trigger value.

2. The household appliance according to claim 1, wherein the at least one door movement parameter is a parameter selected from the group consisting of one or more of the door opening angle, a door movement direction, and a door speed.

3. The household appliance according to claim 1, wherein said camera/sensor module is configured to trigger at least one appliance function assigned to said at least one camera of said camera/sensor module by detecting at least one trigger value by with said at least one inertial sensor of said camera/sensor module.

4. The household appliance according to claim 1, wherein said data communication facility of said camera/sensor module has a bidirectional data interface.

5. The household appliance according to claim 4, wherein said camera/sensor module is configured to be controlled externally.

6. The household appliance according to claim 1, further comprising at least one further camera outside said camera/sensor module, and wherein the household appliance is configured to trigger at least one appliance function assigned to said further camera outside said camera/sensor module by detecting at least one trigger value with said at least one inertial sensor of said camera/sensor module.

7. The household appliance according to claim 1, wherein the household appliance is configured to trigger at least one further appliance function by detecting a further trigger value with the at least one inertial sensor of said camera/sensor module.

8. The household appliance according to claim 1, wherein said camera/sensor module has a housing and said at least one camera and said at least one inertial sensor are arranged in said housing.

9. The household appliance according to claim 8, wherein said housing has a transparent, heatable window which is arranged in a field of view of said at least one camera, and wherein said heatable window is configured to be heated when at least one door movement parameter reaches a given trigger value.

10. The household appliance according to claim 1, wherein said camera/sensor module has a housing and said at least one camera and said at least one inertial sensor are arranged in said housing, and wherein said housing is formed with an insertion opening for inserting said at least one camera, and said insertion opening is closed by said communications printed circuit board.

11. The household appliance according to claim 10, wherein said housing has a transparent, heatable window which is arranged in a field of view of said at least one camera, and wherein said heatable window is configured to be heated when at least one door movement parameter reaches a given trigger value.

12. The household appliance according to claim 1, wherein each said at least one camera and said at least one further camera of said household appliance has a hardware-side code which is unique to the household appliance.

13. The household appliance according to claim 1, wherein the household appliance is a refrigeration appliance and said treatment chamber is a refrigeration chamber.

14. The household appliance according to claim 13, wherein the household appliance is a refrigerator.

15. The household appliance according to claim 4, wherein at least one component of said camera/sensor module is configured to be controlled externally.

16. A household appliance, comprising:

a treatment chamber and a pivotable door for selectively closing said treatment chamber;

at least one camera for recording images from the treatment chamber when the door is open;

a door movement sensor for detecting values of at least one door movement parameter of a door movement of said door;

said door movement sensor having at least one inertial sensor being a rotation rate sensor configured for determining a current door opening angle of said door;

said at least one camera and said at least one inertial sensor being integrated in a camera/sensor module;

said camera/sensor module being arranged in said door and having a data communication facility for emitting image data of said at least one camera of said camera/sensor module; and the household appliance being configured to trigger said at least one camera to acquire image data upon detecting a trigger value and in dependence on the door opening angle.

17. The household appliance according to claim 16, wherein the at least one door movement parameter is a parameter selected from the group consisting of one or more of the door opening angle, a door movement direction, and a door speed.

* * * * *